US009138092B2

(12) United States Patent
Wright et al.

(10) Patent No.: US 9,138,092 B2
(45) Date of Patent: Sep. 22, 2015

(54) FOOTWEAR HANGER

(71) Applicants: Daniel Wright, Bristol (GB); Mark Segasby, Kirby Muxloe (GB)

(72) Inventors: Daniel Wright, Bristol (GB); Mark Segasby, Kirby Muxloe (GB)

(73) Assignee: PHINEAS PRODUCTS LIMITED, Bristol, Avon (GB)

( * ) Notice: Subject to any disclaimer, the term of this patent is extended or adjusted under 35 U.S.C. 154(b) by 0 days.

(21) Appl. No.: 13/768,701

(22) Filed: Feb. 15, 2013

(65) Prior Publication Data

US 2013/0221040 A1 Aug. 29, 2013

Related U.S. Application Data

(60) Provisional application No. 61/598,933, filed on Feb. 15, 2012.

(51) Int. Cl.
*A41D 27/22* (2006.01)
*A47G 25/00* (2006.01)

(52) U.S. Cl.
CPC ..... *A47G 25/005* (2013.01)

(58) Field of Classification Search
CPC ..... A47G 25/005; A47F 7/08
USPC ..... 223/85, 88, DIG. 1; 248/215; 211/34
See application file for complete search history.

(56) References Cited

U.S. PATENT DOCUMENTS 834,188 A 10/1906 Carr
3,661,268 A * 5/1972 Boley ..... 211/49.1
D226,752 S 4/1973 Naoyuki
D229,001 S 11/1973 Wahl
3,987,898 A * 10/1976 Crane ..... 206/300
4,016,981 A * 4/1977 Hildt ..... 211/49.1
D246,083 S 10/1977 Auersperg
D251,891 S 5/1979 Solomon
4,424,905 A * 1/1984 Keen ..... 211/49.1
D296,046 S 6/1988 Marshall
4,823,962 A 4/1989 Arias
4,951,855 A * 8/1990 Jacobson et al. ..... 223/88
4,978,043 A 12/1990 Uke
D323,072 S 1/1992 Anderson et al.
D324,781 S 3/1992 Uke
D342,612 S 12/1993 McIntyre
5,282,553 A 2/1994 Ibled
D412,113 S 7/1999 Josephs
5,931,314 A 8/1999 Jackstat et al.

(Continued)

FOREIGN PATENT DOCUMENTS

FR 2690324 A1 10/1993
FR 2722964 A1 2/1996

(Continued)

OTHER PUBLICATIONS

Design U.S. Appl. No. 29/431,329, filed Sep. 6, 2012.

(Continued)

*Primary Examiner* — Nathan Durham
(74) *Attorney, Agent, or Firm* — King & Schickli, PLLC

(57) ABSTRACT

A footwear hanger including a central stem having support arms for supporting footwear where the arms are attached to the stem and the hanger has a suspension means for attaching the hanger to a display. The stem has a V-shaped or Y-shaped cross-section along at least part of its length which allows the footwear hanger to be easily stacked one on top of the other when stored without footwear being attached.

20 Claims, 7 Drawing Sheets

(56) References Cited

U.S. PATENT DOCUMENTS

| | | | | |
|---|---|---|---|---|
| 6,010,044 | A * | 1/2000 | Hsiao | 223/85 |
| D432,584 | S | 10/2000 | Wakatake et al. | |
| D438,022 | S | 2/2001 | Bunn | |
| 6,402,105 | B1 | 6/2002 | Hoyt et al. | |
| 6,520,349 | B2 * | 2/2003 | Keen | 211/49.1 |
| 7,219,821 | B2 | 5/2007 | Weal et al. | |
| D553,864 | S | 10/2007 | Weal et al. | |
| D631,671 | S | 2/2011 | Segasby | |
| 7,997,464 | B2 | 8/2011 | Weal et al. | |
| 8,201,685 | B1 * | 6/2012 | Licari | 206/300 |
| 2007/0251894 | A1 | 11/2007 | Kelley | |
| 2011/0247185 | A1 | 10/2011 | Bolden et al. | |

FOREIGN PATENT DOCUMENTS

| | | | | |
|---|---|---|---|---|
| FR | 2755360 A1 * | 5/1998 | | A47G 25/80 |
| GB | 2343374 A | 5/2000 | | |
| GB | 2409807 A | 7/2005 | | |
| GB | 2419521 A * | 5/2006 | | A47F 7/08 |

OTHER PUBLICATIONS

Design U.S. Appl. No. 29/451,162, filed Mar. 28, 2013.
Design U.S. Appl. No. 29/451,168, filed Mar. 28, 2013.
Design U.S. Appl. No. 29/443,717, filed Jan. 22, 2013.

* cited by examiner

FOOTWEAR HANGER

This application incorporates U.S. Provisional Patent Application Ser. No. 61/598,933 by reference.

FIELD OF THE INVENTION

The present invention relates to a device for displaying footwear and more s specifically to a footwear hanger.

BACKGROUND OF THE INVENTION

Footwear hangers are well known and are used in many shops for displaying footwear. A number of different styles of footwear hanger are known. U.S. patent application Ser. No. 5,282,553 describes a shoe hanger for displaying shoes in shops having a central rod terminated by a hook and having two arms for supporting shoes which are each composed of an inverted U-shaped arm. In one embodiment, this shoe hanger has a planar cross-section. In another embodiment the hanger has a T-shaped cross section. U.S. patent application Ser. No. 5,931,314 describes a shoe hanger having a central body having two support elements, a hook for suspension and an area for displaying a price, trade mark etc. The cross-section of this shoe hanger is substantially U-shaped.

These shoe hangers have drawbacks. When the hangers described in U.S. Pat. No. 5,282,553 are not in use they may be stacked one on top of the other. It will be noted that the T-shaped cross-sections will not readily stack one on top of the other. Also, the hangers having a planar cross-section have no means to aid stacking when not in use. When the hangers described in U.S. Pat. No. 5,931,314 are not displaying shoes the hangers may be stacked to minimise the space needed. However, it is noted that these hangers do not easily stack one on top of the other. Both of these documents describe hangers having a rod or body which may dig in, rub against or otherwise damage the footwear being displayed which is another drawback.

The present invention seeks to overcome these problems by providing a footwear hanger which can be easily stacked one on top of the other when stored without footwear being attached.

SUMMARY OF THE INVENTION

According to the present invention, there is provided a footwear hanger including a central stem having support arms for supporting footwear attached to the stem and a suspension means for attaching the hanger to a display wherein the stem has a V-shaped or Y-shaped cross-section along at least part of its length.

An advantage of a stem having a V-shaped cross-section is that the hangers, when not in use, can be stacked one on top of the other without taking up as much space as if they were planar, T-shaped or U-shaped.

The V-shape can be any shape which is substantially V-shaped, examples of which are shown in the figures. The V shape can be defined as: two downwardly extending, converging lines which look like a typed V; two downwardly extending, converging lines which have at least one change in trajectory along their path so that each of the lines forming the V form at least one obtuse angle before converging; two downwardly extending lines which converge towards one another but which are linked by a horizontally extending line; two downwardly extending, converging lines which have at least one change in trajectory along their path so that each of the lines forming the V form an obtuse angle which are linked to one another by a horizontal line. The linking horizontal line can be solid or have at least one recess. This embodiment is suited to supporting lightweight footwear.

The Y-shape can be any shape which is substantially Y-shaped, examples of which are shown in the figures. The Y shape can be defined as: two downwardly extending, converging lines with a downwardly extending line from the point where the two lines converge which looks like a typed Y; two downwardly extending, converging lines which have at least one change in trajectory along their path so that each of the lines forming the V portion of the Y form at least one obtuse angle before converging with a downwardly extending line from the point where the two lines converge; two downwardly extending lines which converge towards one another but which are linked by a horizontally extending line having a downwardly extending line halfway along the horizontal line; two downwardly extending, converging lines which have at least one change in trajectory along their path so that each of the lines forming the V portion of the Y form an obtuse angle which are linked to one another by a horizontal line and a downwardly depending line extending from halfway along the horizontal line; two downwardly extending lines which are linked to one another by a horizontally extending line and having a downwardly extending line halfway along the horizontally extending line.

A footwear hanger having a Y-shaped cross-section has improved strength by virtue of the depth of the Y over a shoe hanger having a T-shaped or U-shaped cross-section of the same height. Further, the stacked shoe hangers according to the present invention have a smaller stack height than hangers having a T-shaped cross-section of the same depth as the V or Y-shaped hangers of the invention. The Y shape also permits easy stacking of the hangers one on top of the other. Also, a hanger having a Y-shaped cross-section stem has the advantage that the footwear being displayed is not damaged by sharp edges, unlike in the prior art and that the hangers, when not in use, can be stacked one on top of the other. The Y-shape can be any shape which is substantially Y-shaped as is shown in the figures. The Y shape can also be inverted.

Both the V and Y-shaped cross-sections act as a guide for stacking hangers one on top of the other by virtue of the convergent part of the V. It is envisaged that the V and Y shaped cross-section of the stem can extend over a portion of the footwear hanger at, at least, the points where the hangers will engage with other hangers when stacked. The stem may have a V or Y-shaped cross section throughout its length.

In an embodiment of the invention the stem is in the same plane as the support arms.

By having the central stem and support arms in the same plane a simple mould can be made for manufacturing the hangers. This embodiment of the hanger would have a smaller stack height than a hanger having the support arms and stem in different planes, up to a certain level.

In another embodiment, the stem is in a different plane to the support arms. In this embodiment the support arms are in the substantially vertical plane for displaying the footwear. However, the stem can curve away from the plane in which the shoes are held. This is useful where the footwear to be displayed is delicate and where contact with the stem is undesirable. For example, slippers can be easily marked by a stem due to the softness of the material used to make them. Also, shoes having embellishment, such as sequins, are delicate and contact with the stem could lead to the embellishments being damaged.

In a further embodiment the stem has a kink, a swan-neck shape or a curve or any other shape which results in the stem not being in the same plane as the support arms.

In another embodiment, the hanger is composed of one piece. This simplifies the manufacture of the hanger and saves on assembly costs. Alternatively, the hanger can be composed of a modular system whereby any or both of the suspension means and support arms are attachable to the central stem.

In another embodiment, the hanger is made by injection moulding. Injection moulding is a common and efficient way of manufacturing items. It is preferred that the hanger is manufactured in one piece by injection moulding. This minimises costs by only using one mould to form the pieces.

In an embodiment, the hanger is constructed of a plastics material. This is advantageous as plastics materials are readily available and are usually easy to handle. Further, injection moulding of plastics is a well known process and is also inexpensive to perform once the tooling has been set up. A large number of hangers can be produced in batches which again drives down manufacturing costs. Many plastics materials can be used to make this footwear hanger but preferred materials are polystyrene and polypropylene.

In an embodiment the suspension means is a hook. The hanger can be suspended from a rail or pole by means of the hook. As rails and poles are commonplace in shops no further equipment is required to display the footwear on the hangers in the shops.

In an embodiment the support arms also have a V-shaped cross-section. The V-shaped cross section of the arms leads to more efficient stacking of the hangers when the cross-section of the stem is also a V as hangers stacked above and below a hanger will tessellate. This results in a reduction in the space required for storing the hangers when they are not supporting footwear.

In an embodiment the support arms have a protrusion from the V-shaped cross section to provide a Y shaped cross section. In this embodiment the arms have added strength by virtue of the Y-shape and are suited to hanging heavy footwear. Also, when the arms have a Y-shaped cross section and are joined to a stem with a Y-shaped cross section the hangers may be stacked efficiently in a smaller space than if the hangers had a planar cross-section of the same height of the V or Y shaped cross-section.

In an embodiment the hanger further comprises an extension on which information may be displayed. Information such as shoe sizes, price and/or brand can be affixed to this protrusion to readily display information which may be required by potential purchasers.

In an embodiment the extension on which information is displayed is located proximate to the suspension means. An advantage of locating the protrusion for displaying information close to the suspension means is that it is in a prominent position for the consumer to see.

BRIEF DESCRIPTION OF THE DRAWING FIGURES

The present invention will now be described with reference to the accompanying drawings.

FIG. 8(*a*) to (*d*) show side on views of hangers according to the invention.

DETAILED DESCRIPTION OF THE INVENTION

Figure 1A:
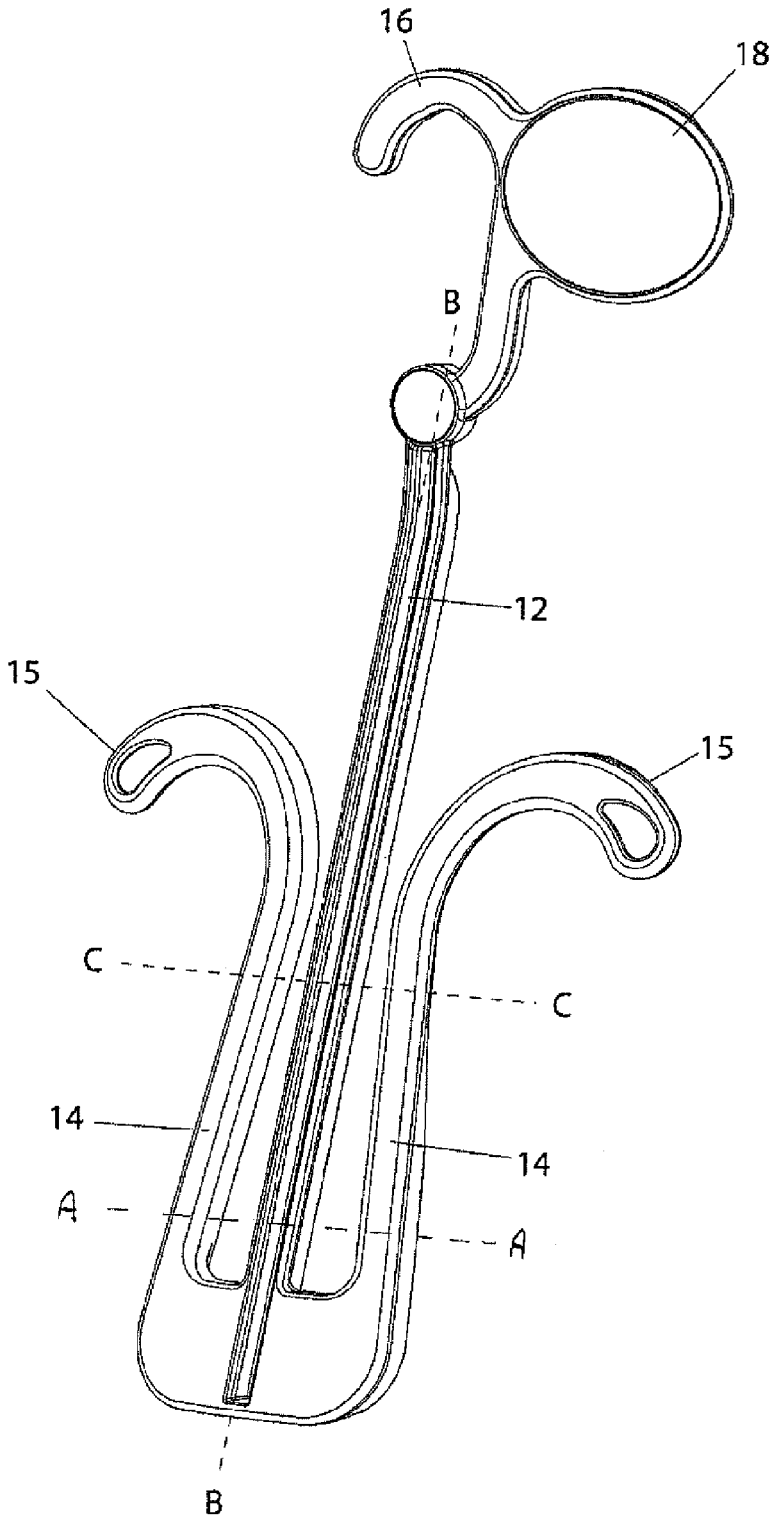
FIG. 1(*a*) is a perspective view of the front and side of a first embodiment of a footwear hanger according to the invention FIG. 1(*b*) is a perspective view of the rear and side of a first embodiment of a footwear hanger.
Figure 1B:
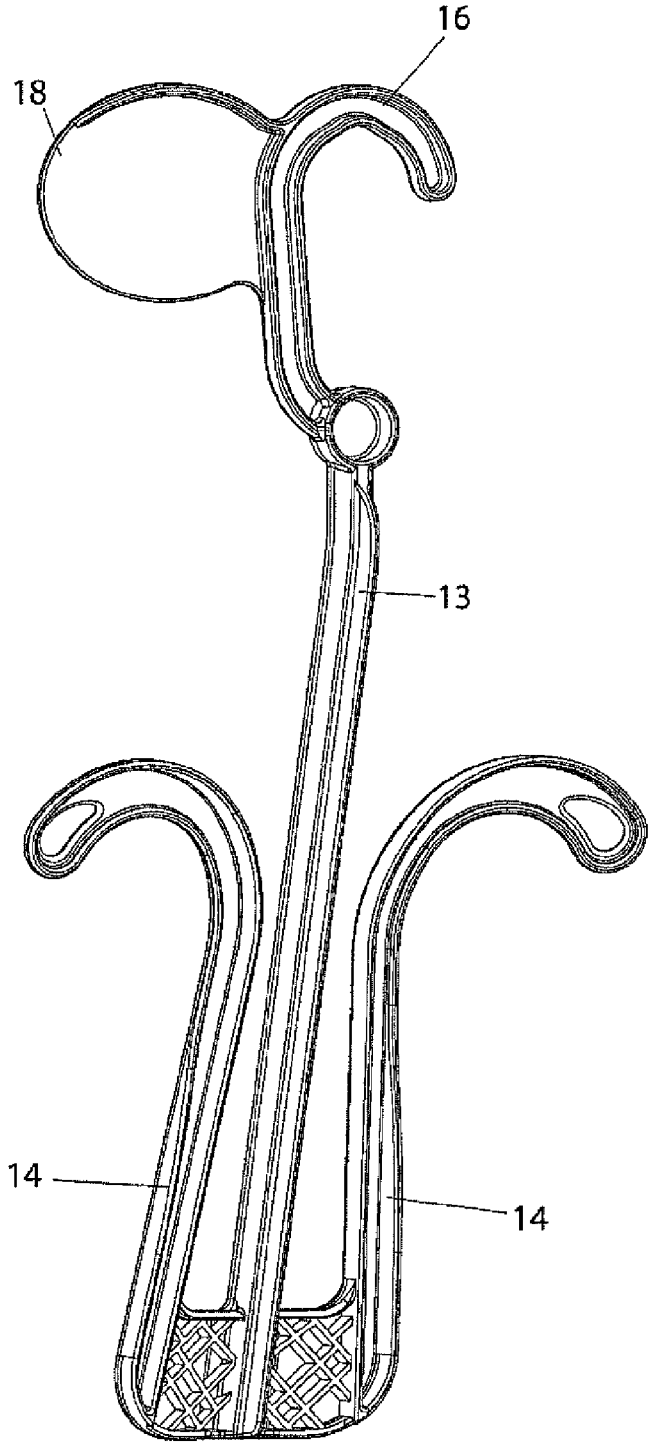

Referring to FIG. 1(*a*), a footwear hanger 10 according to an embodiment of the present invention is shown. The hanger comprises a central stem 12 having a Y-shaped cross-section. The hanger further comprises two arms 14 attached to the stem 12 at its one end. The arms are angled towards the stem 12 from their position of attachment to the stem 12 so that footwear can be supported on the arm close to or against the stem 12 and then diverge away from the stem in an arcuate manner to provide a portion 15 which is located inside a footwear item when in use. At the opposite end to where the arms connect with the stem is a suspension means 16 which is shown as a hook. There is an extension 18 near to the hook which is suitable for displaying information about the product.

FIG. 1(*b*) shows the rear side of the hanger in FIG. 1(*a*). A protrusion 13 is shown which forms the downward shaft of the Y-shape. The support arms 14 are shown as being indented. It is possible for the support arms to be made solid to support heavy footwear, but this would increase the manufacturing costs of the hangers.

Alternatively, the Y-shaped cross-section can be inverted so that the protrusion 13 is located on the front of the hanger 10 when in use.

Figure 2:
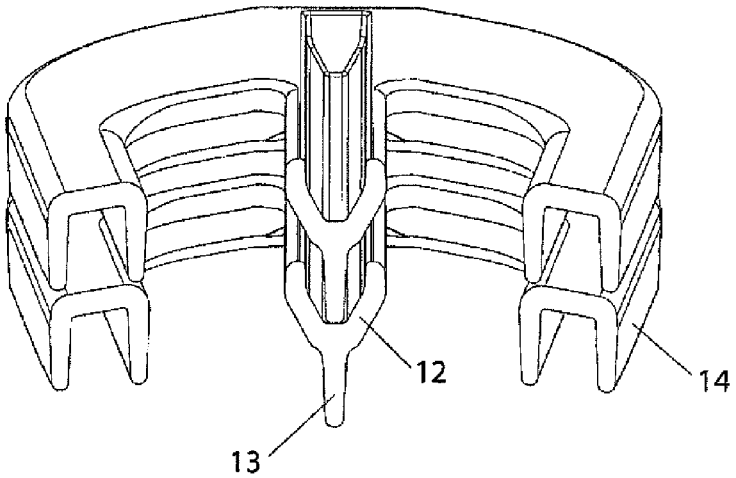
FIG. 2 shows a cross section through a stack of two hangers according to the embodiment shown in FIG. 1(*a*) along line A-A

FIG. 2 shows a cross section of two hangers according to an embodiment of the invention stacked in a cooperating manner. It can be seen that the protrusion 13 on the upper hanger fits in to the V-shaped part of the Y shaped stem in the lower hanger. The support arms are shown as having a U-shaped cross-section but the stacking of the hangers is achieved by virtue of the cross-section of the stem.

Figure 3:
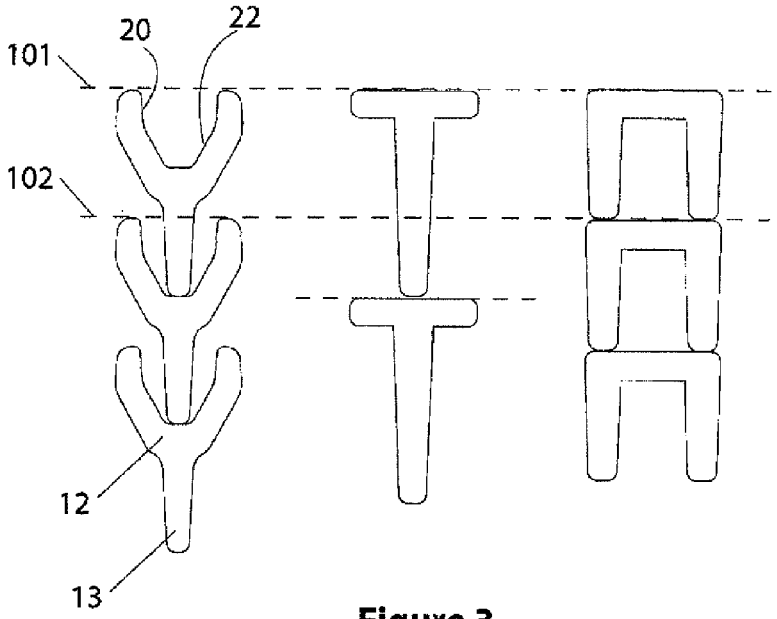
FIG. 3 shows a cross section of the stems of the stacked hangers of an embodiment of the invention and those which are known in the prior art.

FIG. 3 shows how the stacking of a hanger with at least a stem 12 having a Y-shaped cross-section can be stacked in a smaller height than known hangers with a T-shaped cross-section. The dotted lines 101 and 102 shows the stack height of the hangers. The stack height of the hangers according to an embodiment of the invention are about the same as the known hangers with U-shaped cross-sections. However, the inner walls of the upper part of the Y 20, 22 act as a guide for the protrusion 13 of a hanger to be stacked on top by narrowing the space in which the incoming hanger can move. This narrowing can prevent side to side motion of the hanger when stacked which improves stability of the stack.

Figure 4:
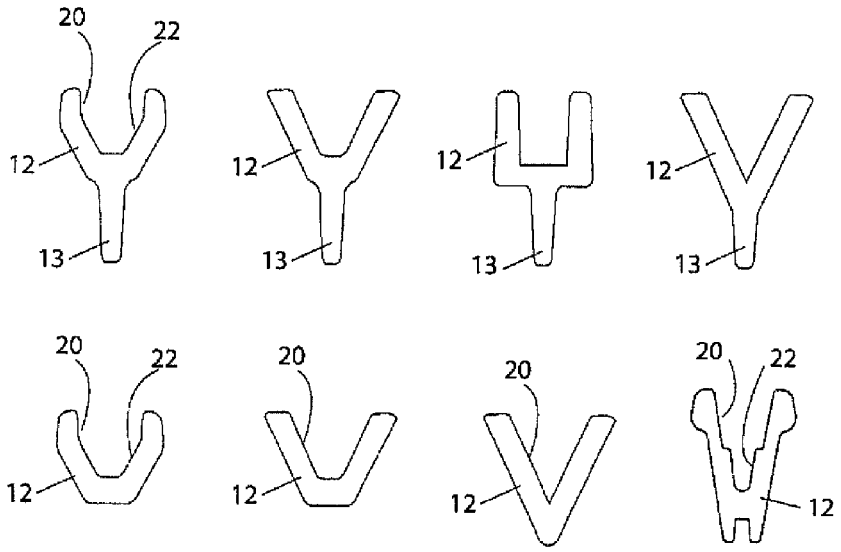
FIG. 4 shows possible shapes of the V and Y cross-sections.

FIG. 4 shows some alternative shapes for the V and Y shaped cross-section which are suitable for this invention. However, it is to be understood that these are not the only possible shapes suited to carry out the invention.

Figure 5:
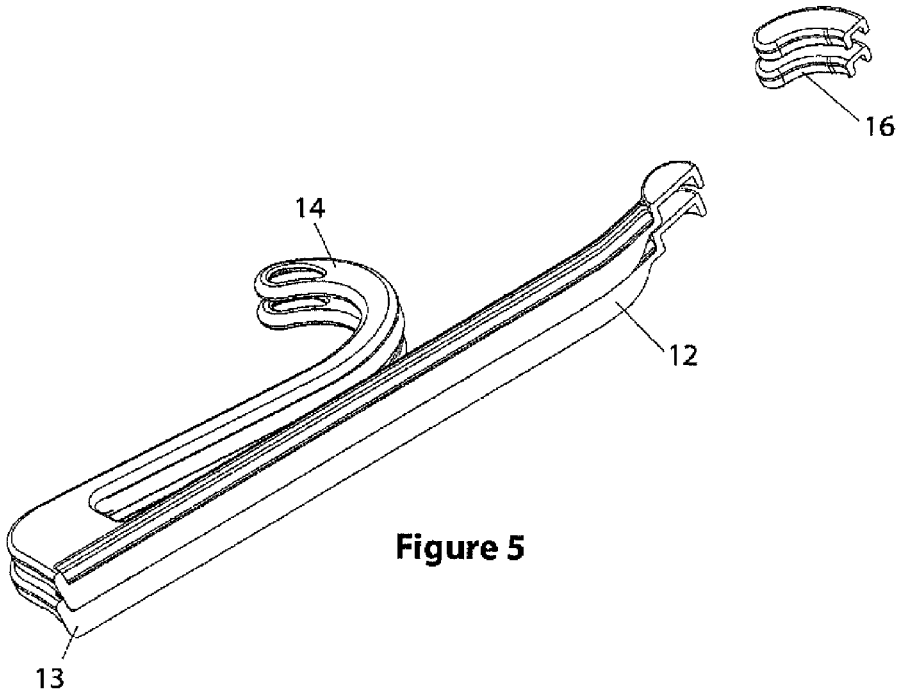
FIG. 5 shows a cross section of a stack of two hangers according to the embodiment shown in FIG. 1(*a*) along the line B-B

FIG. 5 shows a cross-section through hangers according to the embodiment shown in FIG. 1(*a*) along line B-B. This view more clearly shows the Y-shaped stem 12.

Figure 6A:
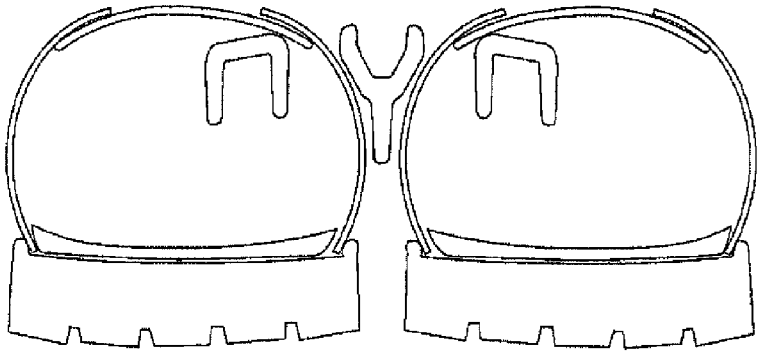
FIGS. 6*a*, 6*b*, and 6*c* show a cross section through the footwear hanger and appended footwear taken along line C-C as shown in FIG. 1(*a*) and through corresponding known T-shaped cross-section hangers and U-shaped cross-section hangers.
Figure 6B:
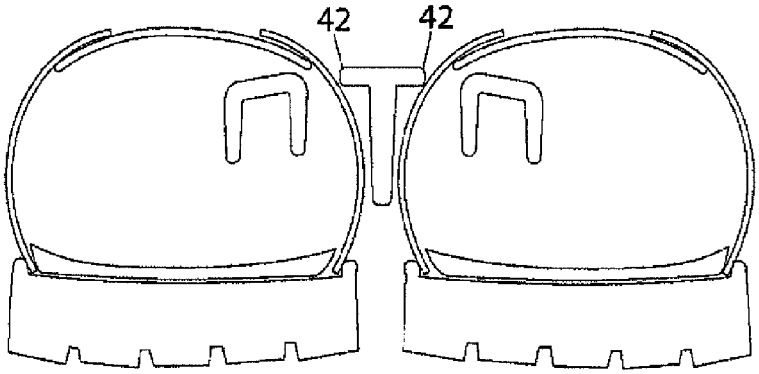
Figure 6C:
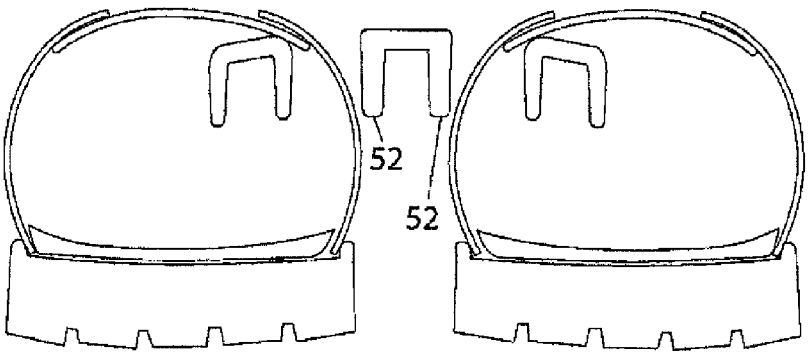

FIGS. 6*a*, 6*b*, and 6*c* show a cross section through the footwear hanger according to an embodiment of the invention taken along line C-C as shown in FIG. 1(*a*) and appended footwear and through corresponding known T-shaped cross-section hangers and U-shaped cross-section hangers. An embodiment of the invention is shown in FIG. 6(*a*) with known footwear hangers shown in FIG. 6(*b*) and (c). It can be seen from FIG. 6(*b*) that the place where the horizontal bar of the T terminates 42 is proximal to the footwear. The termination points 42 can rub on the footwear which causes damage to the footwear which is obviously undesirable. In FIG. 6(*c*) it can be seen that the free ends of the U shape 52 are proximate to the footwear and again can rub on the footwear which causes damage. FIG. 6(*a*) shows the Y-shaped stem not having any points which may cause damage to the footwear as there are no corners in contact with the footwear. This is a further advantage of having a V or Y shaped cross-section as shown in this figure.

Figure 7A:
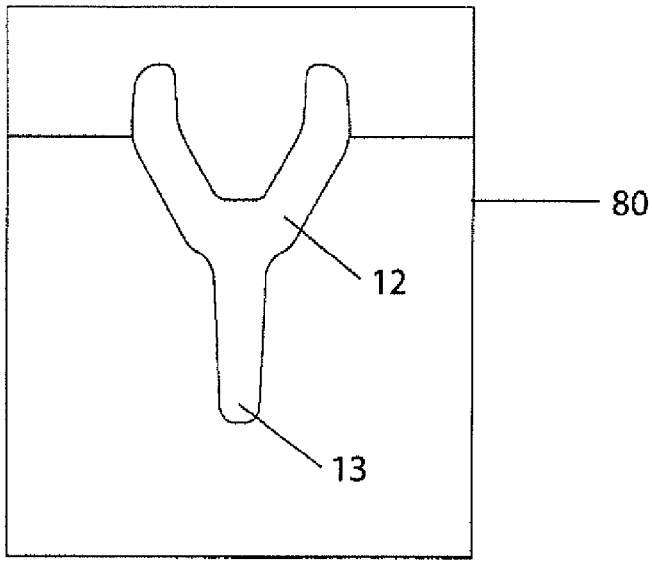
FIG. 7(*a*) shows a mould in cross-section for manufacturing the Y-shaped cross section footwear hanger according to one embodiment of the present invention alongside FIG. 7(*b*) which shows a mould for making a known T-shaped cross-section footwear hanger.
Figure 7B:
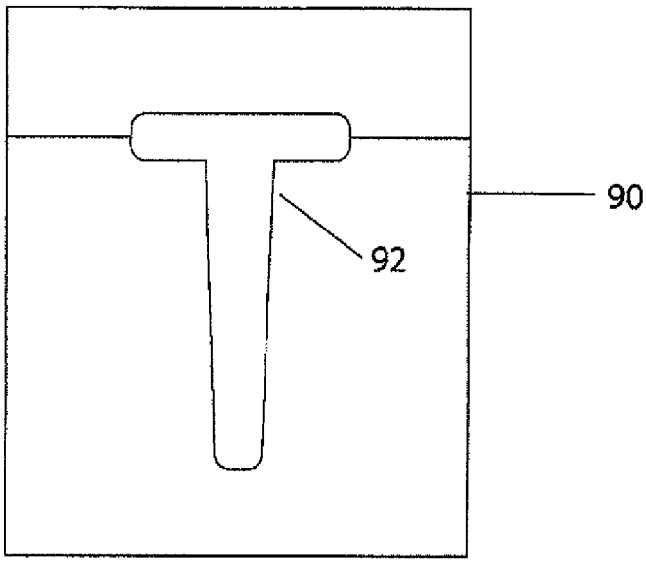
Figure 8A:
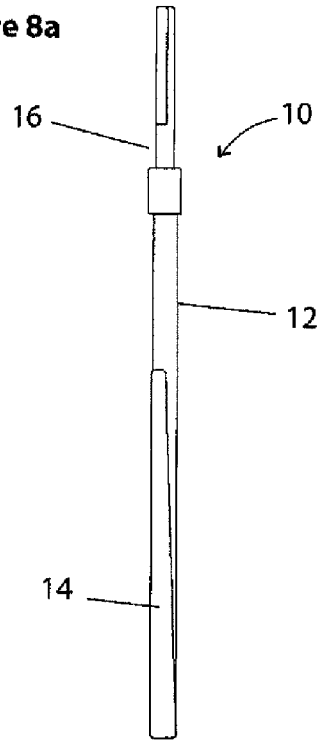
Figure 8B:
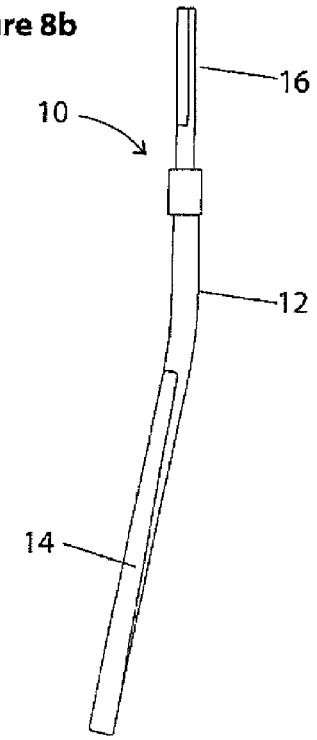
Figure 8C:
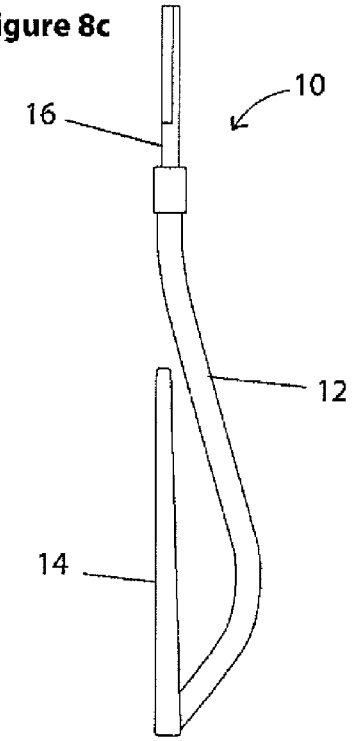
Figure 8D:
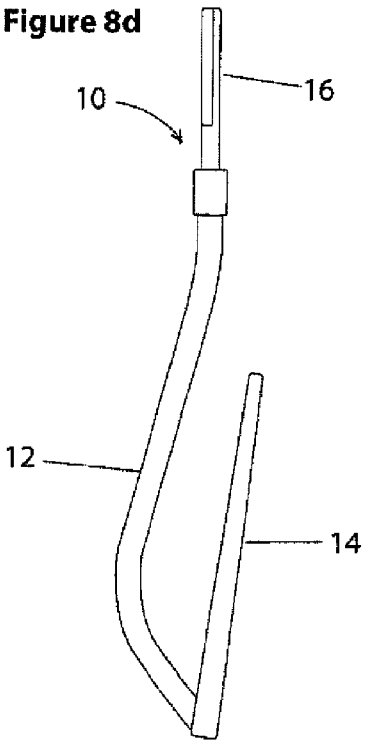

FIG. 7(*a*) shows a mould 80 in cross-section for manufacturing the Y-shaped cross section footwear hanger according to one embodiment of the present invention alongside FIG. 7(*b*) which shows a mould 90 for making a known T-shaped cross-section footwear hanger. It can be seen that there is a thick section 92 at the base of the T shape having the same height as the Y shape. This is not present on the Y shape as only a short height requires draft.

FIG. 8 (*a*) shows a hanger 10 according to an embodiment of the invention where the support arms 14 and stem 12 are in the same plane as one another which is suitable for use with most types of footwear. FIG. 8 (*b*) shows an alternative embodiment where the support arms 14 are parallel to the stem 12 but where the stem is curved. FIG. 8 (*c*) shows another embodiment of a hanger 10 where the stem 12 is in a different plane to the support arms 14. The stem curves away from the support arms where they are attached to the stem and then curves back toward the support arms and continues in a vertical direction. FIG. 8 (*d*) shows yet another embodiment of a hanger 10 where the stem 12 and support arms 14 are in a different plane to one another but where the stem is more distant to the support arms than in FIG. 8 (*c*). Both the embodiments shown in FIGS. 8 (*c*) and (*d*) are more suited to displaying footwear which is delicate and where contact with the stem is undesirable. For example, slippers can be easily marked by a stem due to the softness of the material used to make them. Also, shoes having embellishment, such as sequins, are delicate and contact with the stem could lead to the embellishments being damaged.

In a further embodiment the footwear hanger comprises more than two support arms, for instance four arms for displaying two pairs of shoes.

It will be appreciated by a person skilled in the art that the above embodiments have been described by way of example only, and not in any limiting sense and that modification are possible without departing from the scope of the invention as defined by the claims. Whilst the figures relate to a hanger having a stem with a Y-shaped cross-section, it is understood that a V shape can be used and made in the same way and also has the benefits of being stackable.

The invention claimed is:

1. A footwear hanger including:

a central stem having support arms for supporting footwear attached to the stem, each of said support arms including a U-shaped cross-section along at least a portion thereof; and a suspension means for attaching the hanger to a display;

wherein the stem has a V-shaped or Y-shaped cross-section for promoting efficient stacking of the hanger with another similarly shaped hanger when no footwear is supported; wherein the V-shaped or Y-shaped cross-section is open in a first direction and the U-shaped cross-section is open in a second direction, the second direction being different than the first direction; and wherein an upper portion of the V-shaped or Y-shaped cross-section is adapted to engage a lower portion of the V-shaped or Y-shaped cross-section of the similarly shaped hanger for promoting the efficient stacking.

2. A footwear hanger according to claim 1 wherein the stem further includes a protrusion to give a Y-shaped cross-section along at least part of its length.

3. A footwear hanger according to claim 1 wherein the stem is in the same plane as the support arms.

4. A footwear hanger according to claim 1 wherein the stem is in a different plane to the support arms.

5. A footwear hanger according to claim 1 wherein the hanger is composed of one piece.

6. A footwear hanger according to claim 1 wherein the hanger is made by injection moulding.

7. A footwear hanger according to claim 1 wherein the hanger is constructed of a plastics material.

8. A footwear hanger according to claim 1 wherein the suspension means is a hook.

9. A footwear hanger according to claim 1 wherein the support arms have a V-shaped cross-section.

10. A footwear hanger according to claim 9 wherein the support arms have a protrusion from the V-shaped cross section to provide a Y shaped cross section.

11. A footwear hanger according to claim 1 wherein the hanger further includes an extension on which information may be displayed.

12. A footwear hanger according to claim 11 wherein the extension is located proximate to the suspension means.

13. A footwear hanger according to claim 1, wherein the central stem of the hanger is adapted to receive at least a portion of a second hanger in a stacked configuration.

14. An apparatus for intended use in hanging footwear, comprising:

a first hanger including a first central stem having first support arms for supporting footwear attached to the first central stem, said first central stem including a V-shaped or Y-shaped cross section and said first support arms including a U-shaped cross-section along at least a portion thereof, and a first suspension for attaching the hanger to a display; wherein the V-shaped or Y-shaped cross-section of the first central stem is open in a first direction and the U-shaped cross-section of the first support arms is open in a second direction, the second direction being different than the first direction; and a second hanger including a second central stem having second support arms for supporting footwear attached to the second central stem, said second central stem including a V-shaped or Y-shaped cross section and said second support arms including a U-shaped cross-section along at least a portion thereof; wherein the V-shaped or Y-shaped cross-section of the second central stem is open in a first direction and the U-shaped cross-section of the second support arms is open in a second direction, the second direction being different than the first direction;

wherein the first central stem of the first hanger is adapted for receiving at least a portion of the second central stem of the second hanger when the first and second hangers are stacked.

15. The apparatus of claim 14, wherein the first central stem defines a longitudinal axis extending in a direction from the first suspension to a base of the first hanger, and the longitudinal axis is perpendicular to a plane formed by the V-shaped or Y-shaped cross section.

16. The apparatus of claim 15, wherein the first central stem of the first hanger has a V-shaped cross-section and the second central stem of the second hanger has a V-shaped cross-section.

17. The apparatus of claim 15, wherein the first central stem of the first hanger has a Y-shaped cross-section and the second central step of the second hanger has a Y-shaped cross-section.

18. An apparatus for intended use in hanging footwear from a display, comprising:

a first hanger including a first central stem having first support arms for supporting footwear attached to the first central stem, said first support arms including a U-shaped cross section, and said first central stem including a V-shaped or Y-shaped cross section, and a first suspension for attaching the first hanger to the display; wherein the V-shaped or Y-shaped cross-section of the first central stem is open in a first direction and the U-shaped cross-section of the first support arms is open in a second direction, the second direction being different than the first direction; and a second hanger including a second central stem having second support arms for supporting footwear attached to the second central stem, said second support arms including a U-shaped cross section along at least a portion thereof, and said second central stem including a V-shaped or Y-shaped cross section, and a second suspension for attaching the second hanger to the display; wherein the V-shaped or Y-shaped cross-section of the second central stem is open in a first direction and the U-shaped cross-section of the second support arms is open in a second direction, the second direction being different than the first direction;

wherein at least part of the second central stem of the second hanger is positioned in a recess formed by the V-shaped or Y-shaped cross section of the first central stem of the first hanger when the first and second hangers are stacked.

19. The apparatus of claim 18, wherein the first central stem of the first hanger has a V-shaped cross-section and the second central stem of the second hanger has a V-shaped cross-section.

20. The apparatus of claim 18, wherein the first central stem of the first hanger has a Y-shaped cross-section and the second central stem of the second hanger has a Y-shaped cross-section.

* * * * *